US008648764B2

(12) United States Patent
McLaughlin et al.

(10) Patent No.: US 8,648,764 B2
(45) Date of Patent: Feb. 11, 2014

(54) COMPONENTS AND METHODS FOR DESIGNING EFFICIENT ANTENNAE

(75) Inventors: Bryan McLaughlin, Cambridge, MA (US); Douglas W. White, Lexington, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 385 days.

(21) Appl. No.: 13/116,618

(22) Filed: May 26, 2011

(65) Prior Publication Data

US 2012/0299793 A1 Nov. 29, 2012

(51) Int. Cl.
*H01Q 1/48* (2006.01)

(52) U.S. Cl.
USPC ..... 343/848

(58) Field of Classification Search
USPC ..... 343/700 MS, 829, 846, 848
See application file for complete search history.

(56) References Cited

U.S. PATENT DOCUMENTS

| | | | | |
|---|---|---|---|---|
| 5,892,486 | A | 4/1999 | Cook et al. | |
| 6,133,882 | A | 10/2000 | LaFleur et al. | |
| 6,452,552 | B1 | 9/2002 | Ishitobi et al. | |
| 6,741,214 | B1 * | 5/2004 | Kadambi et al. | 343/700 MS |
| 6,819,287 | B2 * | 11/2004 | Sullivan et al. | 343/700 MS |
| 7,116,276 | B2 * | 10/2006 | Lee | 343/700 MS |
| 7,362,283 | B2 * | 4/2008 | Illera et al. | 343/846 |
| 7,528,790 | B2 * | 5/2009 | Desclos et al. | 343/841 |
| 7,782,269 | B2 | 8/2010 | Castany et al. | |
| 8,427,373 | B2 * | 4/2013 | Jiang et al. | 343/700 MS |
| 2008/0252536 | A1 | 10/2008 | Anguera et al. | |
| 2010/0171666 | A1 | 7/2010 | Mizutani et al. | |
| 2010/0194654 | A1 | 8/2010 | Chiang | |

OTHER PUBLICATIONS

Arya et al., "Efficiency enhancement of microstrip patch antenna with defected ground structure," in *Recent Advances in Microwave Theory and Applications, 2008. Microwave 2008. International Conference on Microwave*, 2008, pp. 729-731.

Bhattacharyya, "Effects of ground plane and dielectric truncations on the efficiency of a printed structure," *Antennas and Propagation, IEEE Transactions on Antennas and Propagation*, vol. 39, pp. 303-308, 1991.

Bokhari et al., "Radiation pattern computation of microstrip antennas on finite size ground planes," *Microwaves, Antennas and Propagation, IEEE Proceedings H*, vol. 139, pp. 278-286, 1992.

Huang, "The finite ground plane effect on the microstrip antenna radiation patterns," *Antennas and Propagation, IEEE Transactions on Antennas and Propagation*, vol. 31, pp. 649-653, 1983.

Singh et al., "Microstrip patch antenna with defected ground structure & defected microstrip structure," in *Recent Advances in Microwave Theory and Applications, 2008. Microwave 2008. International Conference on Microwave*, 2008, pp. 937-938.

Tavakkol-Hamedani et al., "The effects of substrate and ground plane size on the performance of finite rectangular microstrip antennas," in *Antennas and Propagation Society International Symposium, 2002. IEEE*, 2002, pp. 778-781 vol. 1.

* cited by examiner

*Primary Examiner* — Seung Lee
(74) *Attorney, Agent, or Firm* — Goodwin Procter LLP

(57) ABSTRACT

An antenna features a ground plane having a continuous portion and one or more stubs extending therefrom.

15 Claims, 6 Drawing Sheets

COMPONENTS AND METHODS FOR DESIGNING EFFICIENT ANTENNAE

FIELD OF THE INVENTION

In various embodiments, the present invention relates to antennae and, in particular, to antenna components that are suitable for improving an antenna's performance and methods for the design thereof.

BACKGROUND

Various types of antennae, including patch antennae, are employed with wireless-communication devices such as cell phones, hand-held personal digital assistant (PDA) devices, GPS receivers, laptop and tablet PCs, etc. Patch antennae are generally well suited for use with many such devices, in part because they have a low profile (i.e., height) and are relatively easy and inexpensive to manufacture. A typical patch antenna includes a radiating element that is used to both transmit and receive signals, and a ground plane. The radiating element and the ground plane are typically "patches," i.e., substantially flat pieces of metal such as copper. The radiating element and the ground plane are generally disposed substantially parallel to each other, separated by a dielectric substrate disposed therebetween.

In general, the amount of electromagnetic power to be transmitted using a patch antenna and/or the strength of the signal to be received affect, in part, the size of the radiating element. The greater the power to be transmitted (or the weaker the signal to be received), the larger the required radiating element. However, if the radiating element is too large the antenna can become unsuitable for use with small devices such as cell phones or Bluetooth transceivers.

In designing antennae, typically two objectives are important. First, it is desirable to manufacture an antenna having a high efficiency. The efficiency of an antenna is the ratio of the power of a transmitted (i.e., radiated) signal to the input power, i.e., the power of the signal received for subsequent transmission. The second objective is to increase the gain of the antenna. The antenna gain is the ratio of the intensity of the radiation of the antenna in a desired direction to the intensity of radiation that would be produced by a hypothetical ideal antenna that radiates equally in all directions, and has no losses. Thus, the antenna gain relates to a fraction of the total power transmitted by the antenna in a desired direction. Other objectives in antenna design may include the desired frequency of transmission/reception and bandwidth of the antenna.

The size of the antenna's ground plane substantially affects the various antenna parameters described above, including the antenna's efficiency and gain. To achieve high efficiency (e.g., about 57%) and gain (e.g., about +5 dB), a typical ground plane is designed to be significantly larger than the radiating element, adding to the overall size of the antenna. For example, appliances such as cell phones, Bluetooth devices, and GPS receivers often employ an antenna that includes a radiating element of about 25 mm×25 mm. A typical ground plane used with such an antenna overlaps the radiating element and extends from each side of the radiating element by about 25 mm, so that the antenna's efficiency is about 57%. The distance by which the ground plane extends beyond the radiating element is called the "border." Thus, the size of a typical antenna is about 75 mm×75 mm. The requirement for a large ground plane can make the communication device large and bulky, and, as described above, the antenna may be so large in some instances that it may become unsuitable for certain applications. On the other hand, a relatively small ground plane can decrease the antenna's efficiency and/or gain substantially, also making it unsuitable for certain applications.

One approach to addressing this problem is to introduce "defects" in the ground plane or to provide a cavity adjacent the ground plane. In a defected ground plane, a portion of the electrically conductive material (e.g., copper) comprised within the ground plane is removed from one or more locations, altering current distributions within the ground plane. This can mitigate current-crowding losses, and thus increase the antenna's efficiency. But, the removal of the conductive material permits radiation to be emitted through the defect, causing a reduction in the antenna's front-to-back-gain ratio. In other words, an antenna having a defected ground plane may transmit less radiation in a desired direction than an antenna of a similar size and structure, but having a defect-free (i.e., continuous) ground plane. For its part, the addition of a cavity often makes the antenna thicker, bulkier, and/or heavier.

Accordingly, there is a need for an improved antenna that can meet the multiple goals of small size, high efficiency, and high gain.

SUMMARY

In various embodiments, the present invention features an antenna that operates at a high efficiency (i.e., at an efficiency comparable to that achievable using a large ground plane), while being substantially smaller in size than an antenna having the large ground plane. In certain embodiments, this is achieved, in part, by providing a ground plane having i) a continuous portion that is about the same size as that of the radiating element of the antenna, and ii) stubs extending from the continuous portion. The stubs may be folded into various shapes such that the total size of the ground plane (including the stubs) is smaller than that of a conventional, large ground plane. The stubs may also be formed by removing sections of material (e.g., metallization) that would otherwise be a part of a conventional ground plane.

In general, in one aspect, embodiments of the invention feature an antenna that includes a radiating element, such as a metallic plate, and a ground plane. The ground plane includes a continuous portion (e.g., a metallic plate or layer) that is substantially overlapped by the radiating element. At least one stub extends from the continuous portion such that the stub(s) and the radiating element do not substantially overlap. The at least one stub may be coplanar with the continuous portion, and, in some embodiments, it extends at about a right angle with respect to a side of the continuous portion. One or more of the stubs may be L-shaped, inter-locking L-shaped, shaped as a meander-line, or shaped as a Hilbert-curve. In some embodiments, one or more of the stubs modify an electrical length of the ground plane (e.g., the distance over which currents are induced in the ground plane). As a result, the antenna's efficiency may be adjusted to a target efficiency. The continuous portion of the ground plane may be shaped as a rectangle, a square, a circle, or an oval. The antenna may also include a dielectric substrate positioned between the radiating element and the ground plane. In some embodiments, the radiating element includes a substantially continuous surface (e.g., a layer or foil of an electromagnetic material).

In general, in another aspect, embodiments of the invention feature a method of manufacturing an antenna. The method includes locating a first ground plane, having a continuous portion, in proximity to a radiating element such that the continuous portion is substantially overlapped by the radiating element. The method also includes providing at least one stub in electrical communication with and extending from the continuous portion such that the one or more stubs and the radiating element are substantially non-overlapping. The geometry (e.g., shape, one or more dimensions, etc.) of the one or more stubs is selected to achieve a target efficiency for the antenna.

In some embodiments, the method includes, prior to locating the first ground plane: positioning a second ground plane, different from the first ground plane, in proximity to the radiating element such that the second ground plane covers the radiating element; measuring an efficiency associated with the radiating element (i.e., the measured efficiency corresponds to an antenna that includes the radiating element and the second ground plane); changing a size of the second ground plan; repeating the positioning, measuring, and size-changing steps so as to determine a size of the second ground plane that maximizes the efficiency measured in the measuring step; and setting the target efficiency for the antenna to the maximum measured efficiency. These steps may be simulated, for example by using antenna modeling software.

The one or more stubs may be positioned to be coplanar with the continuous portion of the first ground plane and/or at about a right angle to a side of the continuous portion. In some embodiments, the stubs are L-shaped, inter-locking L-shaped, shaped as a meander-line, or shaped as a Hilbert-curve. The method may also include selecting a shape of the continuous portion of the first ground plane to be at least one of a rectangle, a square, a circle, or an oval. In some embodiments, a dielectric substrate is positioned between the radiating element and the first ground plane.

These and other objects, along with advantages and features of the embodiments of the present invention herein disclosed, will become more apparent through reference to the following description, the accompanying drawings, and the claims. Furthermore, it is to be understood that the features of the various embodiments described herein are not mutually exclusive and can exist in various combinations and permutations. As used herein, the term "substantially" means ±10%, and in some embodiments ±5%.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1A:
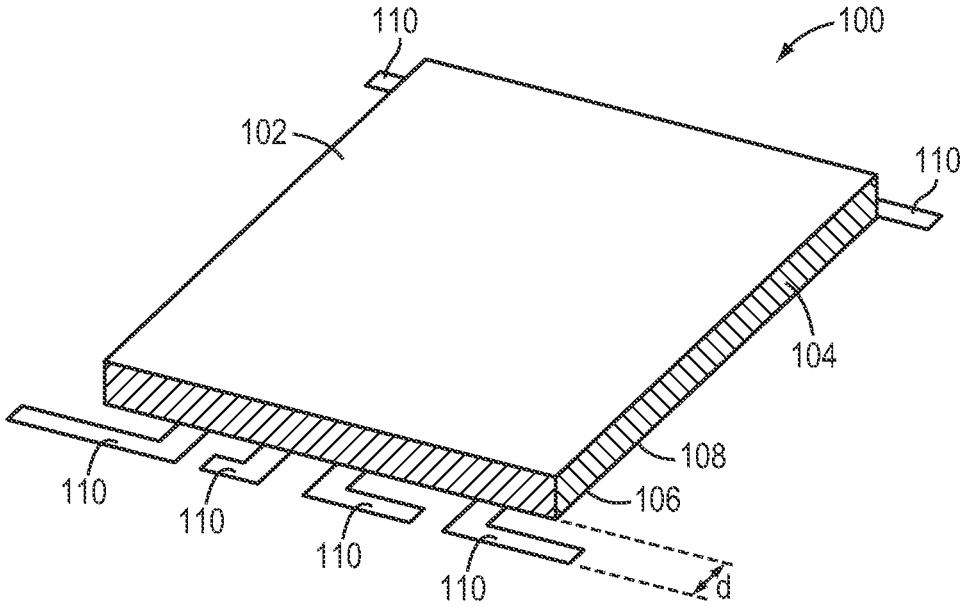
FIGS. 1A and 1B show an isometric view and a side view, respectively, of an exemplary antenna having a ground plane in accordance with one embodiment of the present invention.
Figure 1B:
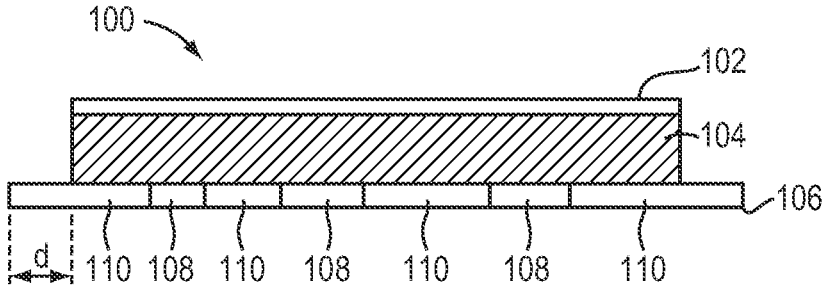

An exemplary patch antenna 100 shown in FIGS. 1A and 1B includes a radiating element 102. The radiating element 102 both radiates electromagnetic energy when the antenna 100 operates as a transmitter, and receives radiation when the antenna 100 operates as a receiver. As depicted, the radiating element 102 features a substantially continuous (i.e., defect-free) surface. The radiating element 102 is disposed over a first surface (e.g., the top surface) of a substrate 104 that typically comprises a dielectric material, such as a ceramic, oxides of various metals, TMM 13, duroid, etc. A ground plane 106 comprising a continuous (i.e., defect-free) portion 108 is disposed over another surface (e.g., the bottom surface) of the substrate 104. Both the radiating element 102 and the continuous portion 108 of the ground plane 106 comprise or consist essentially of electrically conductive materials or nano-materials, e.g., metals, such as copper, silver, gold, aluminum, etc. The ground plane 106 also comprises coplanar, discrete stubs 110 that are described below in detail. The stubs 110 are in electrical communication with the continuous portion 108 of the ground plane 106 and extend beyond the footprint of the radiating element 102 (i.e., the radiating element 102 does not overlap, or cover, the stubs 110). Although FIG. 1A shows both the radiating element 102 and the continuous portion 108 of the ground plane 106 as squares, this is for illustrative purposes only, and it will be understood by one of ordinary skill in the art that radiating elements and/or ground planes of different shapes, such as a rectangle, a circle, an oval, etc., are within the scope of the invention.

Signal generating and/or receiving circuitry (not shown) is in electrical communication with the radiating element 102. When the antenna 100 is operated as a transmitter, the circuitry provides the electrical signal to be transmitted to the radiating element 102, and when the antenna 100 is operated as a receiver, the circuitry converts the electromagnetic radiation received by the radiating element 102 into a received signal. The transmitted and/or received signals can include messages to be transmitted and/or received using the antenna 100.

As described above, and as illustrated in FIG. 2A, a typical conventional patch antenna 210 that includes a 25 $mm^2$ radiating element 212 employs a 75 $mm^2$ ground plane 216 so as to achieve an antenna efficiency of about 57%. In the conventional antenna 220 shown in FIG. 2B, instead of using a ground plane having a 25 mm border, a ground plane 226 having a 10 mm border (i.e., 35 mm×35 mm in size) is used, causing the efficiency of the antenna 220 to decrease to about 43%. With reference to FIGS. 1A, 1B, and 2C, in one embodiment of the present invention, the radiating element 102 substantially overlaps the continuous portion 108 of the ground plane 106 (e.g., the continuous portion 108 of the ground plane 106 has a border of approximately 0 mm). Nevertheless, because the stubs 110 extend from the continuous portion 108 by a distance "d" of approximately 10 mm, the ground plane 106 of the antenna 100 has a total size (including the stubs 110) of about 35 mm×35 mm, which is comparable to the size of the low-efficiency conventional antenna 220 depicted in FIG. 2B. Yet, it has been found that the efficiency of the antenna 100 depicted in FIGS. 1A, 1B, and 2C is about 55%, which is comparable to that of the higher-efficiency conventional patch antenna 210 depicted in FIG. 2A.

Figure 2A:
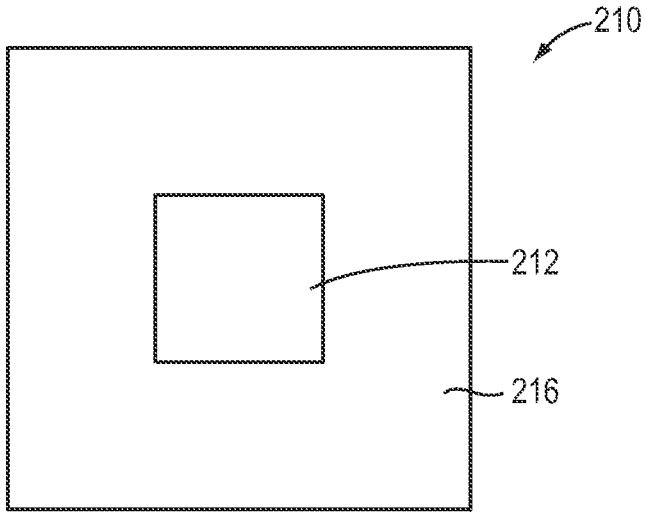
FIG. 2A (PRIOR ART)
FIGS. 2A and 2B show top views of two conventional antennae.
Figure 2B:
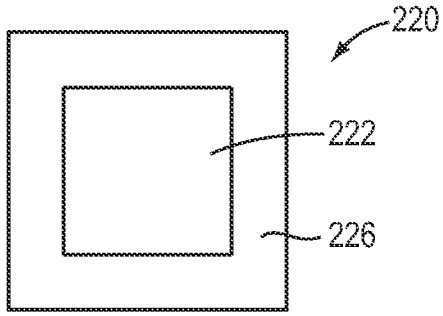
FIG. 2B (PRIOR ART)
Figure 2C:
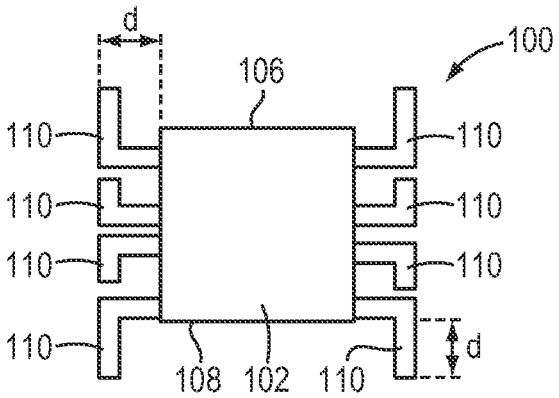
FIGS. 2C and 2D show two antennae according to two different embodiments of the present invention.

In part, the smaller antenna 100 depicted in FIG. 2C has an efficiency comparable to that of the larger antenna 210 depicted in FIG. 2A because the coplanar "L" shaped stubs 110 increase the distance (i.e., electrical length) over which currents in the ground plane 106 flow, thereby changing the current distribution in the continuous portion 108 of the ground plane 106. Moreover, because the continuous portion 108 of the ground plane 106 and the radiating element 102 are of approximately the same size in the antenna 100 of FIG. 2C, negligible, if any, radiation is emitted from the radiating element 102 through the ground plane 106. Therefore, the front-to-back ratio, or gain, of the antenna 100 is substantially unaffected.

As can be seen (e.g., by comparing FIG. 2C to FIG. 2B), adding stubs 110 to a continuous portion 108 of a ground plane 106 can result in an increase in the efficiency of the antenna 100 without an increase in the overall size of the antenna. Alternatively, for an antenna of a given size, by employing the stubs 110, one can increase the size of the radiating element 102 (and thereby the power of a signal transmitted) without sacrificing the antenna's efficiency.

Figure 2D:
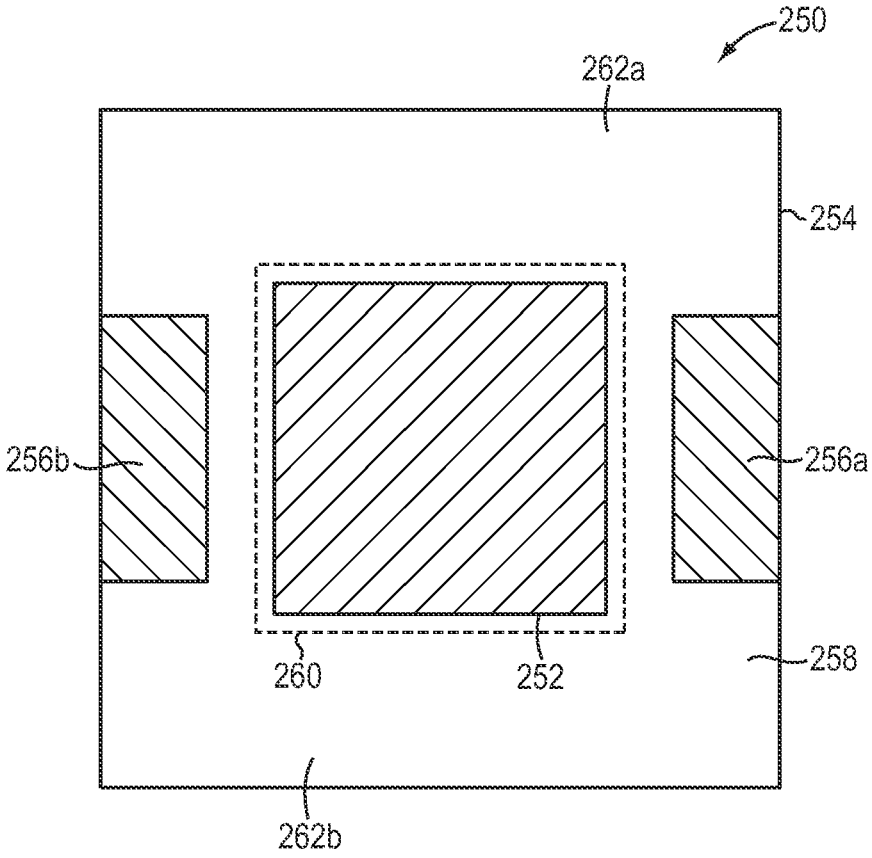

In the antenna 250, illustrated in FIG. 2D, stubs are formed by removing portions of a ground plane. In particular, the antenna 250 includes a radiating element 252, and a ground plane 254. The portions 256*a*, 256*b* are removed from the ground plane 254, thereby forming an "I" or "H" shaped ground plane 258 having a continuous portion 260. The I or H-shaped ground plane 258 also includes a number of interlocked stubs (i.e., stubs that are joined together) forming extensions 262*a*, 262*b*. The extensions 262*a*, 262*b* extend from the continuous portion 260, and they do not overlap with the radiating element 252. The removed portions 256*a*, 256*b* may be filled with a suitable dielectric material.

Figure 3:
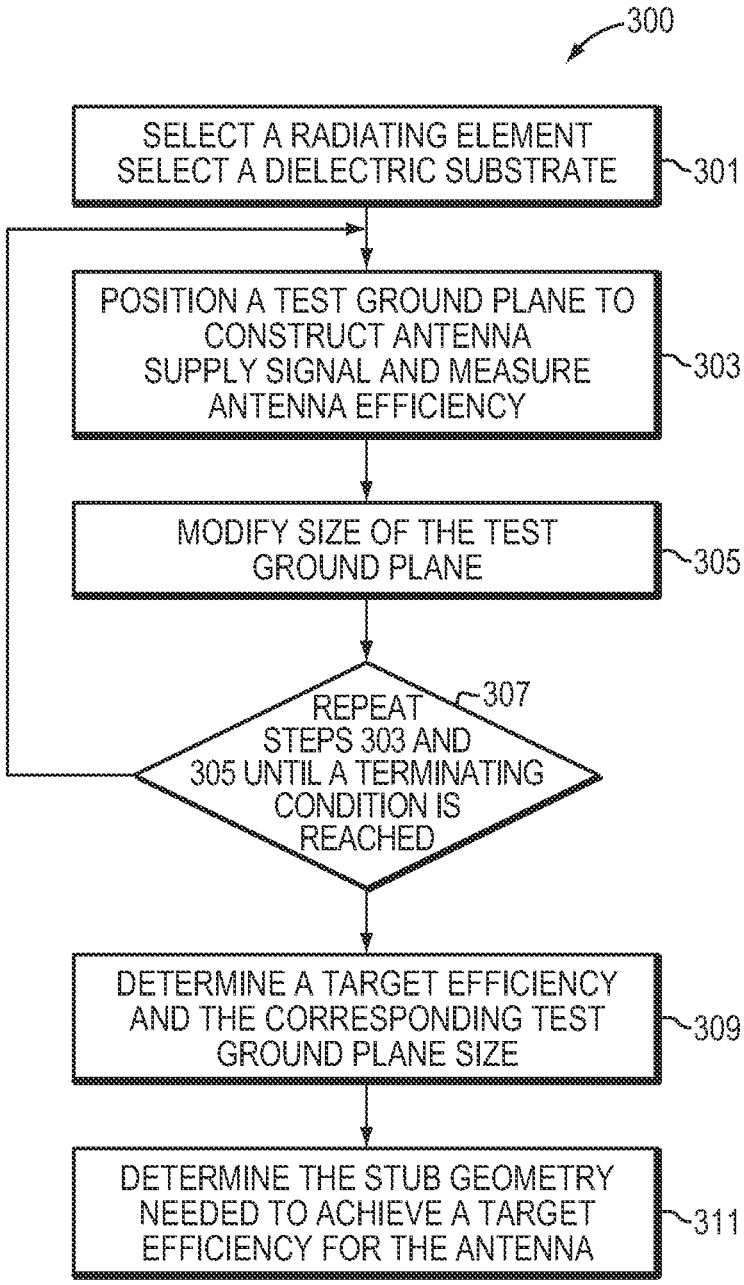
FIG. 3 is a flowchart depicting the steps in one embodiment of a method for designing the stubs of a ground plane.

FIG. 3 is a flowchart depicting the steps in one embodiment of a method 300 for designing (e.g., selecting the geometry of) the stubs 110 of the ground plane 106. In step 301, a radiating element 102 of a suitable shape and size is first selected. The shape (e.g., a square, a rectangle, a circle, an oval, etc.) and the size may be determined based, at least in part, on the power to be transmitted and/or the strength of the signal to be received, as well as on the requirements of the device (e.g., PDA, GPS receiver, etc.) that will house the antenna 100. A substrate 104 comprising a suitable dielectric material and having a specified thickness (e.g., 1 mm, 2 mm, 5 mm, etc.) is also selected in step 301. These substrate 104 parameters affect one or more of the antenna 100 parameters, namely, the efficiency, gain, frequency of operation (e.g., 500 MHz, 2 GHz, etc.), and bandwidth (10 MHz, 50 MHz, etc.), and, hence, may be selected so as to yield the desired antenna 100 parameters. For example, a certain dielectric material (e.g., TMM 13, alumina, duroid, etc.) of a certain thickness may be preferable so that the antenna 100 operates at a specified frequency.

In step 303, an antenna is constructed by appropriately positioning a test ground plane (i.e., a ground plane, without stubs, that is used for testing purposes) in proximity to the selected radiating element 102 and substrate 104. The test ground plane is different from the actual ground plane 106 having the stubs 110 that is ultimately selected for use in the antenna 100. Initially, the test ground plane has a size that is about the same as that of the radiating element 102 (i.e., the test ground plane initially has a border of 0 mm). A signal is then supplied to the radiating element 102 and parameters of the antenna, including its efficiency, are measured. As will be understood by one of ordinary skill in the art, in step 303, a physical antenna may be constructed and actual signals may be supplied thereto and parameters measured therefrom. Alternatively, the antenna may be modeled, and signals may be supplied thereto and parameters measured therefrom through simulation.

In step 305, the dimensions of the test ground plane are increased (e.g., the sides of the test ground plane are extended beyond the border of the radiating element 102 in each direction) by a predetermined value (e.g., 5 mm, 10 mm, etc.). Step 303 is then repeated to determine a new efficiency value for the antenna.

As indicated in step 307, steps 303 and 305 are repeated for a certain number of iterations, or until further increases in the border size do not yield a substantial change in the antenna's efficiency or in any other antenna parameter of choice. In particular, the antenna's efficiency does not monotonically increase with the increase in the size of the test ground plane, and may in fact decrease once the test-ground-plane size reaches a certain value. From the selected test-ground-plane sizes and measured efficiency values, a maximum measured efficiency value and the corresponding border size can be determined in step 309. The maximum measured efficiency value can be set as the target efficiency for the antenna 100 depicted in, for example, FIGS. 1A, 1B, and 2C. Alternatively, a desired efficiency (e.g., a measured efficiency less than the maximum measured efficiency and corresponding to a different border size) can be set, in step 309, as the target efficiency for the antenna 100.

In step 311, the geometry (e.g. total length, shape, etc.) of the one or more stubs 110 that is needed to achieve the target efficiency for the antenna 100 is determined. As further described below, the stubs 110 can be straight or may be "folded" (e.g., "L" shaped, shaped as a meander-line, or shaped as a Hilbert-curve, etc.). In some embodiments, the maximum size of the antenna 100 (and, thus, the ground plane 106) footprint will be pre-specified (e.g., due to customer specifications). For example, while a test ground plane having a border size of 25 mm may have been determined in step 309 to maximize the antenna's efficiency, the customer specifications may only permit a border size of 10 mm. In such a case, one works to shape the stubs 110 within the 10 mm border to achieve an efficiency for the antenna 100 that is as close as possible to the target, maximum efficiency. The border size of the test ground plane determined in step 309 may give an experienced designer intuitive feel or insight into the geometry that the stubs 110 should feature. Various different geometries, numbers, etc. of the stubs 110 may be tested (e.g., through simulation or through an actual physical model of the antenna) until the efficiency of the antenna 100 is as close as possible to the target efficiency. Once the desired geometry of the stubs 110 is determined, the stubs 110 are formed to extend from a continuous portion 108 (e.g., a metallic plate, foil, layer on the substrate 104, etc.) that has a size and shape about the same as that of the radiating element 102 selected in step 301. These stubs 110 and continuous portion 108 form the actual ground plane 106 of the antenna 100.

Figure 4:
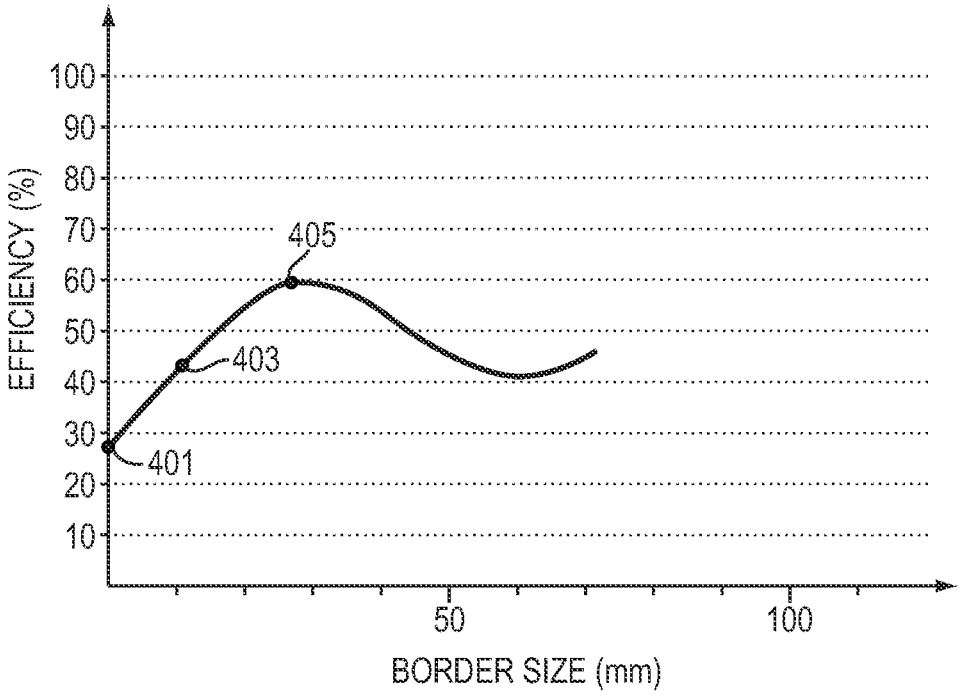
FIG. 4 shows a relationship between the size of a conventional ground plane and an antenna's efficiency.

FIG. 4 shows various border sizes and the corresponding measured efficiencies, as described above with reference to FIG. 3, for an exemplary antenna having a conventional ground plane. In particular, the values depicted in FIG. 4 are for an antenna having a radiating element of approximately 25 mm×25 mm, a dielectric substrate approximately 1.27 mm thick, and a frequency of operation of approximately 1.575 GHz. At data point 401, the border size is approximately 0 mm and the efficiency of the antenna is about 28%. The antenna's efficiency increases to about 43%, at data point 403, when the border size is approximately 10 mm. As seen at the data point 405, the efficiency peaks at about 57% when the border size is about 25 mm. The antenna's efficiency decreases as the border size is increased beyond 25 mm. Accordingly, this suggests that an antenna 110 operating at maximum efficiency should be able to be achieved by employing a ground plane 106 having a continuous portion 108 of about 25 mm×25 mm, and stubs 110 of appropriate geometry extending therefrom. The total size of such a ground plane 106 can be substantially smaller than 75 $mm^2$, which is the size that a conventional ground plane (i.e., a ground plane without stubs) would need to be in order for the antenna to operate at the maximum efficiency. For example, the total size of the ground plane 106 (including the stubs 110) may be only 35 $mm^2$, 50 $mm^2$, etc., while still achieving the maximum efficiency of 57%.

Figure 5A:
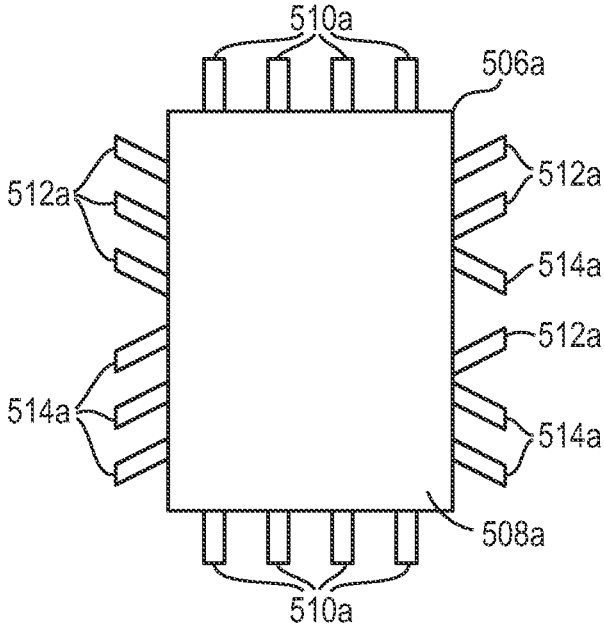
FIGS. 5A-5C show ground planes having different shapes, and stubs of different shapes, in accordance with various embodiments of the present invention.
Figure 5B:
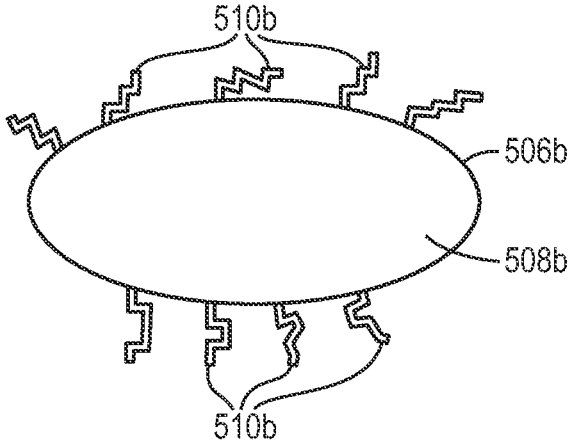
Figure 5C:
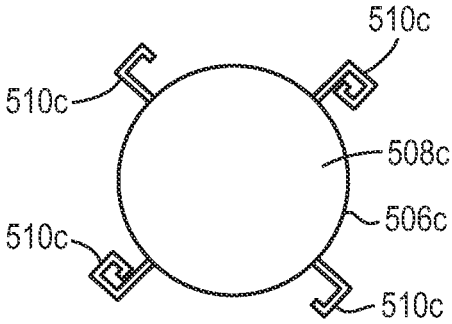

FIGS. 5A-5C depict various configurations of exemplary ground planes that may be employed in various embodiments of the present invention. In particular, FIG. 5A shows a ground plane 506*a* having a rectangular continuous portion 508*a* and discrete, straight stubs 510*a*, 512*a*, 514*a*. The straight stubs 510*a* extend at approximately 90 degrees from (i.e., at a right angle with respect to) the sides of the continuous portion 508*a*, and are co-planar with the continuous portion 508*a*. As depicted, the straight stubs 512*a* and 514*a* extend at angles other than the right angle. The stubs 512*a* and 514*a* are also depicted to be non-coplanar with the continuous portion 508*a* (i.e., if the continuous portion 508*a* lies within the plane of the page, stubs 512*a* and 514*a* are directed into or out of the page at a certain angle). FIG. 5B shows a ground plane 506*b* having a continuous portion 508*b* in the shape of an oval, and discrete, meandering stubs 510*b*. FIG. 5C shows a ground plane 506*c* having a circular continuous portion 508*c*, and discrete stubs 510*c* that have the shape of a Hilbert curve. It should be understood, however, that the configurations shown in FIGS. 5A-5C are illustrative only and that other combinations using these and other shapes for the continuous portions and/or the stubs can be achieved and are within the scope of the invention. Moreover, a single ground plane can have different stubs of different shapes.

While the invention has been particularly shown and described with reference to specific embodiments, it will be understood by those skilled in the art that various changes in form and detail may be made therein without departing from the spirit and scope of the invention as defined by the appended claims. The scope of the invention is thus indicated by the appended claims and all changes that come within the meaning and range of equivalency of the claims are therefore intended to be embraced.

What is claimed is:

1. An antenna, comprising:

a radiating element; and a ground plane, comprising:

i) a continuous portion that is substantially overlapped by the radiating element; and ii) at least one stub extending from the continuous portion such that the at least one stub and the radiating element are substantially non-overlapping, wherein the at least one stub modifies an electrical length of the ground plane, thereby adjusting an efficiency of the antenna to a target efficiency.

2. The antenna of claim 1, wherein the at least one stub is coplanar with the continuous portion.

3. The antenna of claim 1, wherein the at least one stub is positioned at about a right angle with respect to a side of the continuous portion.

4. The antenna of claim 1, wherein the at least one stub is selected from the group consisting of an L-shaped stub, an inter-locking L-shaped stub, a meander-line stub, and a Hilbert-curve stub.

5. The antenna of claim 1, wherein the continuous portion has a shape selected from the group consisting of a rectangle, a square, a circle, and an oval.

6. The antenna of claim 1 further comprising a dielectric substrate positioned between the radiating element and the ground plane.

7. The antenna of claim 1, wherein the radiating element comprises a substantially continuous surface.

8. A method of manufacturing an antenna, the method comprising:

locating a first ground plane, having a continuous portion, in proximity to a radiating element such that the continuous portion is substantially overlapped by the radiating element; and providing at least one stub in electrical communication with and extending from the continuous portion such that the at least one stub and the radiating element are substantially non-overlapping, the geometry of the at least one stub modifying an electrical length of the first ground plane and thereby adjusting an efficiency of the antenna to a target efficiency.

9. The method of claim 8 further comprising, prior to locating the first ground plane:

a. positioning a test ground plane, different from the first ground plane, in proximity to the radiating element such that the test ground plane covers the radiating element;

b. measuring an efficiency associated with the radiating element;

c. changing a size of the test ground plane;

d. repeating steps a through c so as to determine a size of the test ground plane that maximizes the efficiency measured in step b; and e. setting the target efficiency for the antenna to the maximum measured efficiency.

10. The method of claim 9, wherein steps a through e are simulated.

11. The method of claim 8, wherein providing the at least one stub comprises positioning the at least one stub to be coplanar with the continuous portion.

12. The method of claim 8, wherein providing the at least one stub comprises positioning the at least one stub at about a right angle to a side of the continuous portion.

13. The method of claim 8, wherein providing the at least one stub comprises selecting from amongst an L-shaped stub, an inter-locking L-shaped stub, a meander-line stub, and a Hilbert-curve stub.

14. The method of claim 8 further comprising selecting a shape of the continuous portion to be at least one of a rectangle, a square, a circle, or an oval.

15. The method of claim 8 further comprising positioning a dielectric substrate between the radiating element and the first ground plane.

* * * * *